US008514074B2

(12) United States Patent
Egawa et al.

(10) Patent No.: US 8,514,074 B2
(45) **Date of Patent: *Aug. 20, 2013**

(54) ALARM

(75) Inventors: Yoshitaka Egawa, Tokyo (JP); Hidenari Matsukuma, Yamato (JP)

(73) Assignee: Hochiki Corporation, Tokyo (JP)

( * ) Notice: Subject to any disclaimer, the term of this patent is extended or adjusted under 35 U.S.C. 154(b) by 350 days.

This patent is subject to a terminal disclaimer.

(21) Appl. No.: 12/991,318

(22) PCT Filed: Nov. 25, 2008

(86) PCT No.: PCT/JP2008/071339

§ 371 (c)(1),
(2), (4) Date: Nov. 5, 2010

(87) PCT Pub. No.: WO2009/136458

PCT Pub. Date: Nov. 12, 2009

(65) Prior Publication Data

US 2011/0057794 A1 Mar. 10, 2011

(30) Foreign Application Priority Data

May 8, 2008 (JP) ..... 2008-121900

(51) Int. Cl.
*G08B 21/00* (2006.01)

(52) U.S. Cl.
USPC ..... 340/540

(58) Field of Classification Search
USPC ..... 340/540, 506, 628, 632, 636.1; 702/63
See application file for complete search history.

(56) References Cited

U.S. PATENT DOCUMENTS

| | | | | |
|---|---|---|---|---|
| 3,510,863 | A | 5/1970 | McBrian | |
| 5,889,468 | A * | 3/1999 | Banga | 340/628 |
| 6,028,513 | A * | 2/2000 | Addy | 340/539.16 |
| 6,078,269 | A | 6/2000 | Markwell et al. | |
| 6,150,936 | A | 11/2000 | Addy | |
| 2001/0038336 | A1 * | 11/2001 | Acevedo | 340/628 |
| 2005/0010769 | A1 | 1/2005 | You et al. | |
| 2006/0082453 | A1 | 4/2006 | Kaiser | |
| 2007/0063837 | A1 | 3/2007 | McKenna et al. | |

FOREIGN PATENT DOCUMENTS

| | | | |
|---|---|---|---|
| CN | 1192086 | A | 9/1998 |
| EP | 1501060 | A1 | 1/2005 |
| JP | 62-168299 | | 7/1987 |
| JP | 04-076697 | | 3/1992 |

(Continued)

OTHER PUBLICATIONS

Japanese Patent Office, Search Report in International Patent Application No. PCT/JP2008/071339 dated Feb. 24, 2009.

(Continued)

*Primary Examiner* — Phung Nguyen

(57) ABSTRACT

An alarm comprising: a transmission reception circuit unit transmitting and receiving an event signal with an other alarm; a sensor unit detecting an abnormality; an alerting unit outputting an abnormality warning; an abnormality monitoring unit receiving an abnormality detection signal from the sensor unit, while outputting the abnormality warning of a coordination source, and transmitting to the other alarm the event signal indicating an abnormality, meanwhile, outputting the abnormality warning of a coordination end when the event signal indicating an abnormality is received from the other alarm; and an inspection processing unit transmitting to the other alarm an event signal indicating a self inspection result, and, when an event signal indicating an inspection result is received from the other alarm, reporting an inspection result of a plurality of alarms in coordinated relation.

8 Claims, 7 Drawing Sheets

(56) References Cited

FOREIGN PATENT DOCUMENTS

| | | |
|---|---|---|
| JP | 05-079694 | 10/1993 |
| JP | 07-182574 | 7/1995 |
| JP | 09-035159 | 2/1997 |
| JP | 09-115074 | 5/1997 |
| JP | 09-212777 | 8/1997 |
| JP | 2000-137889 | 5/2000 |
| JP | 2002-074535 | 3/2002 |
| JP | 2005-038401 | 2/2005 |
| JP | 2005-044318 | 2/2005 |
| JP | 2005-222319 | 8/2005 |
| JP | 2006-011791 | 1/2006 |
| JP | 2006-067020 | 3/2006 |
| JP | 2006-178723 | 7/2006 |
| JP | 2006-339762 | 12/2006 |
| JP | 2006-350412 | 12/2006 |
| JP | 2007-094719 | 4/2007 |
| JP | 2007-200004 | 8/2007 |
| JP | 2007-318566 | 12/2007 |
| JP | 2008-033410 | 2/2008 |
| JP | 2008-33428 | 2/2008 |
| JP | 2008-108074 | 5/2008 |
| WO | 0043968 A1 | 7/2000 |
| WO | 2006085781 A1 | 8/2006 |

OTHER PUBLICATIONS

Office Action issued in Japanese Patent Application No. 2012-018948; Mar. 12, 2013; 8 pages; Japanese Patent Office.

Office Action issued in Chinese Patent Application No. 2008801290220; Jan. 31, 2013; 18 pages; State Intellectual Property Office of the People's Republic of China.

International Search Report issued in International Patent Application No. PCT/JP2009/054848; Apr. 28, 2009; 6 pages; Japanese Patent Office.

Notice of Allowance issued in U.S. Appl. No. 12/933,698; Dec. 7, 2012; 8 pages; U.S. Patent and Trademark Office.

Office Action issued in Japanese Patent Application No. 2012-018949; Feb. 19, 2013; 6 pages; Japanese Patent Office.

Supplementary European Search Report and Written Opinion, issued in European Application No. EP 09724915.5, mailed on May 6, 2013 (17 pages).

Supplementary European Search Report and Written Opinion, issued in European Application No. EP 08874206.9, mailed on May 7, 2013 (8 pages).

* cited by examiner

*FIG. 4*

64

| ALARM ID | INSPECTION RESULT |
|---|---|
| 01 | NORMAL (0) |
| 02 | NORMAL (0) |
| 03 | NORMAL (0) |
| 04 | ABNORMAL (1) |
| 05 | NORMAL (0) |

ALARM

TECHNICAL FIELD

The present invention relates to an alarm which detects an emergency such as a fire and issues an alert, and also transmits a signal to another alarm via radio transmission, thereby issuing an alert in coordination.

Priority is claimed on Japanese Patent Application No. 2008-121900, the content of which is incorporated herein by reference.

BACKGROUND ART

A conventional alarm known as a residential alarm is configured to detect emergencies such as a fire or a gas leak in a residence, and issues an alert by letting out a warning sound, for example. In recent years, multiple alarms are installed in one residence, and emergencies such as a fire are monitored for each room.

When multiple alarms are installed in a residence as described above, and an individual is present in a room separate from a room at which a fire occurs, the individual might not hear the warning sound, and a disaster such as the fire might spread. Thus, a suggestion for issuing a warning in coordination is made so that, the alarms are connected via a wire line, and when one alarm detects a fire, the alarm transmits a signal to another alarm and simultaneously lets out a warning sound (for example, refer to Japanese Unexamined Patent Application, First Publication No. 2007-094719).

However, connecting the alarms via a wire line requires a power distribution work, leading to an increase in cost. This problem may be resolved by employing an alarm with radio transmission capability. Further, since the power consumption of recent ICs for a wireless circuit is decreasing, even if the alarm is in an operating mode so that transmission can be received at all times in order to be capable of receiving a signal from another alarm, a battery life exceeding five years, for instance, is installed, allowing practical use. Therefore, the practical application of a wireless-type alarm is spreading.

Incidentally, according to these types of alarms, an automatic checkup feature is provided to ensure that fires are monitored for an extended period of time. According to this automatic checkup feature, for example, an operating condition of a luminous element and a light receiving element provided on a smoke detection unit, which detects smoke due to fire, are examined, and it is determined periodically whether or not the alarm is normal or abnormal, and when the detection results indicates an abnormality, an alert is issued by letting out a warning sound or by illuminating an LED.

DISCLOSURE OF INVENTION

However, the automatic checkup feature of conventional alarms are configured so that, when an alert is issued in coordination by forming a group of wireless type alarms, the detection result is alerted at each individual alarm installed in different rooms. Thus, for each alarm in the group, it is necessary to examine the detection result by going to the places at which the alarms are installed. In this way, there is a problem in that the examination of the detection result requires time and effort.

The present invention is made considering the problems described above. Consequently, an object of the present invention is to provide an alarm which can issue an alert of a detection result of a plurality of alarms issuing a warning in coordination, in a simple and easy manner.

In order to solve the above problem, an alarm according to the present invention employs the following configuration:

(1) In other words, an alarm according to the present invention includes a transmission reception circuit unit transmitting and receiving an event signal with an other alarm; a sensor unit detecting an abnormality; an alerting unit outputting an abnormality warning; an abnormality monitoring unit receiving an abnormality detection signal from the sensor unit, while outputting the abnormality warning of a coordination source, and transmitting to the other alarm the event signal indicating an abnormality, meanwhile, outputting the abnormality warning of a coordination end when the event signal indicating an abnormality is received from the other alarm; and an inspection processing unit transmitting to the other alarm an event signal indicating a self inspection result, and, when an event signal indicating an inspection result is received from the other alarm, reporting an inspection result of a plurality of alarms in coordinated relation.

(2) In addition, an other alarm according to the present invention includes a transmission reception circuit unit transmitting and receiving an event signal with an other alarm; a sensor unit detecting an abnormality; an alerting unit outputting an abnormality warning; an abnormality monitoring unit receiving an abnormality detection signal from the sensor unit, while outputting the abnormality warning of a coordination source, and transmitting to the other alarm the event signal indicating an abnormality, meanwhile, outputting the abnormality warning of a coordination end when the event signal indicating an abnormality is received from the other alarm; and an inspection processing unit registering an inspection result of a self to a control table, and, transmitting to the other alarm an event signal indicating the inspection result, when an event signal indicating an inspection result is received from the other alarm registering the inspection result received into the control table, and, when a predetermined operation input is discerned, reporting an inspection result of a plurality of alarms in coordinated relation based on the control table.

(3) In addition, the alarm described in (1) or (2) may be configured as follows: the inspection processing unit transmits to the other alarm an event signal indicating an abnormality when the inspection result changes from normal to abnormal, and transmits to the other alarm an event signal indicating a normal condition when the inspection result changes from abnormal to normal.

(4) In addition, the alarm described in (2) may be configured as follows: when the inspection processing unit receives an event signal indicating an abnormality, the inspection processing unit rewrites an inspection result of a corresponding alarm to abnormal in the control table, meanwhile, when the inspection processing unit receives an event signal indicating a normal condition, the inspection processing unit rewrites an inspection result of a corresponding alarm to normal in the control table.

(5) In addition, the alarm described in (2) may be configured as follows: when the inspection processing unit discerns a predetermined operation input, the inspection processing unit outputs an alerting sound indicating an occurrence of an abnormality when an inspection result of at least one alarm registered to the control table is abnormal, and outputs an alerting sound indicating a normal condition when an inspection result of all alarms is normal.

(6) In addition, the alarm described in (2) may be configured as follows: when the inspection processing unit discerns a predetermined operation input, the inspection processing unit transmits to an alarm at an abnormality occurrence source an event signal indicating an abnormality alert when an inspection result of an alarm registered with the control table is abnormal, meanwhile, the inspection processing unit outputs an alerting sound indicating an occurrence of an abnormality when the inspection processing unit receives an event signal from the other alarm indicating an abnormality alert.

(7) In addition, the alarm described in (1) or (2) may be configured as follows: the sensor unit includes a light emitting element and a light receiving element, and is a smoke detection unit converting a light received at the light receiving element to a light reception signal; and the inspection processing unit detects a first light reception level of the light receiving element when the light emitting element is illuminated, and also detects a second light reception level of the light receiving element when the light emitting element is not illuminated, and determines a difference between the first light reception level and the second light reception level, and when the difference is less than a predetermined threshold, the inspection result is set to abnormal, meanwhile, when the difference is greater than or equal to the predetermined threshold, the inspection result is set to normal.

(8) In addition, the alarm described in (1) or (2) may be configured as follows: the sensor is a temperature detection unit comprising a temperature detection element; and the inspection processing unit sets an inspection result to abnormal when the inspection processing unit detects a short, in which a resistance value of the temperature detection element becomes approximately zero, or when the inspection processing unit detects a severance, in which a resistance value of the temperature detection element becomes approximately infinitely large, and in an other instance, the inspection processing unit sets the inspection result to normal.

According to an alarm based on the present invention, a result of a self inspection, which is performed individually among a plurality of alarms executing a warning in coordination, is communicated to one another. As a result, each alarm can retain to a control table, an inspection result of a plurality of alarms executing a warning in coordination. In addition, when a predetermined switch operation is performed with regards to an optional alarm, the control table is checked, and when there is at least one alarm indicating that its inspection result is abnormal, an alerting sound indicating an abnormality is outputted. On the other hand, the control table is checked, and when the inspection result of all the alarms is normal, an alerting sound indicating a normal condition is outputted. Therefore, by operating one optional alarm, it is possible to figure out the inspection result of all of the alarms in coordination with one another. Compared to a case in which the inspection result is checked for each alarm, the time and effort spent on the checking procedure is greatly reduced. Consequently, the maintenance and control of the plurality of alarms executing the warning in coordination becomes easy. Therefore, the overall reliability may be enhanced.

In addition, when an inspection result is reported by an optional alarm, and another alarm is the source at which an abnormality occurred, a signal indicating an abnormality alert is transmitted to the alarm at the source of the abnormality, thus reporting the source of the abnormality. Therefore, the alarm at the source at which the abnormality occurred may be easily checked. Furthermore, an appropriate response such as repair and exchange may be performed as well.

BRIEF DESCRIPTION OF THE DRAWINGS

FIG. 4 is a descriptive view illustrating a checkup control table according to FIG. 3.

DESCRIPTION OF REFERENCE NUMERALS

Figure 1B:
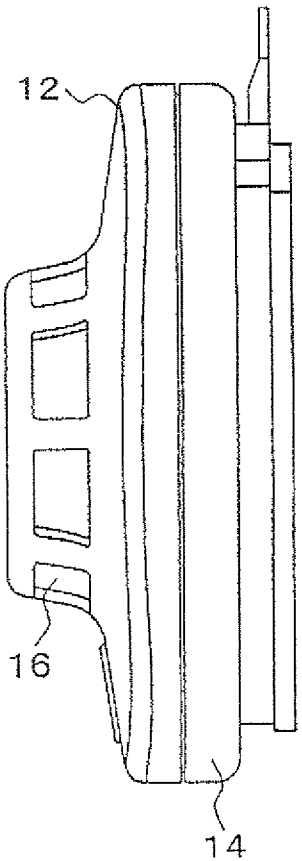
FIG. 1B is a side view of the alarm.

10, 10-1 to 10-5 alarm
12 cover
14 main body
15 mounting hook
16 smoke detection unit
18 acoustic hole
20 warning halting switch
22 LED
24 residence
26 garage
28 CPU
30 wireless circuit unit
31 antenna
32 record circuit unit
34 sensor unit
36 alerting unit
38 operation unit
40 battery source
42 transmission circuit
44 reception circuit
46 memory
48 event signal
50 transmission source reference
52 group reference
54 event reference
58 speaker
60 emergency monitoring unit
62 checking processing unit
64 checking control table

BEST MODE FOR CARRYING OUT THE INVENTION

Figure 1A:
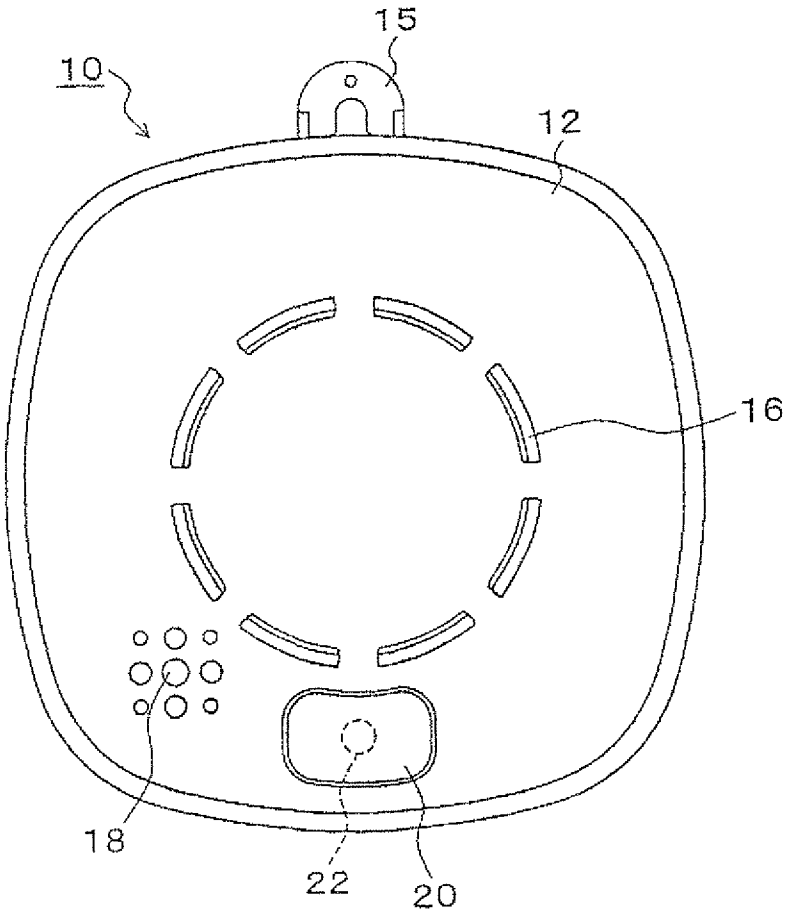
FIG. 1A is a frontal view showing an external appearance of an alarm according to an aspect of the present invention.

FIGS. 1A and 1B are descriptive diagrams showing an external appearance of a wireless type alarm according to the present invention. FIG. 1A shows a frontal view, and FIG. 1B shows a side view.

According to FIGS. 1A and 1B, an alarm 10 according to an embodiment of the present invention comprises a cover 12 and a main body 14. A smoke detection unit 16 is provided on the center of the cover 12. A smoke influx opening is provided at a peripheral of the smoke detection unit 16. Thus, fire is detected when the density of smoke due to fire reaches a predetermined density.

An acoustic hole 18 is provided at a lower left side of the smoke detection unit 16 provided on the cover 12. A speaker may be embedded behind this resonance hole 18, and thereby warning sounds and audio messages may be outputted. At a lower side of the smoke detection unit 16, a warning halting switch 20 is provided. This warning halting switch 20 acts as an inspection switch.

Inside the warning halting switch 20, an LED 22 is provided as shown in dotted lines. When the LED 22 is illuminated, the condition with which the LED 22 is illuminating can be seen from the outside through the switch cover part of the warning halting switch 20.

First, a mounting hook 15 is provided at an upper part of the back side of the main body 14. The alarm 10 may be provided to a wall surface by inserting a screw into a wall of a room in which the alarm 10 is to be set up, and by attaching the alarm 10 to the screw using the mounting hook 15.

Incidentally, according to the alarm 10 shown in FIGS. 1A and 1B, an alarm, which detects a smoke by a fire and includes a smoke detection unit 16, is shown as an example. Other than this configuration, the scope of the present invention includes an alarm including a thermistor which detects heat due to fire, and an alarm detecting a gas leak as well as a fire.

Figure 2:
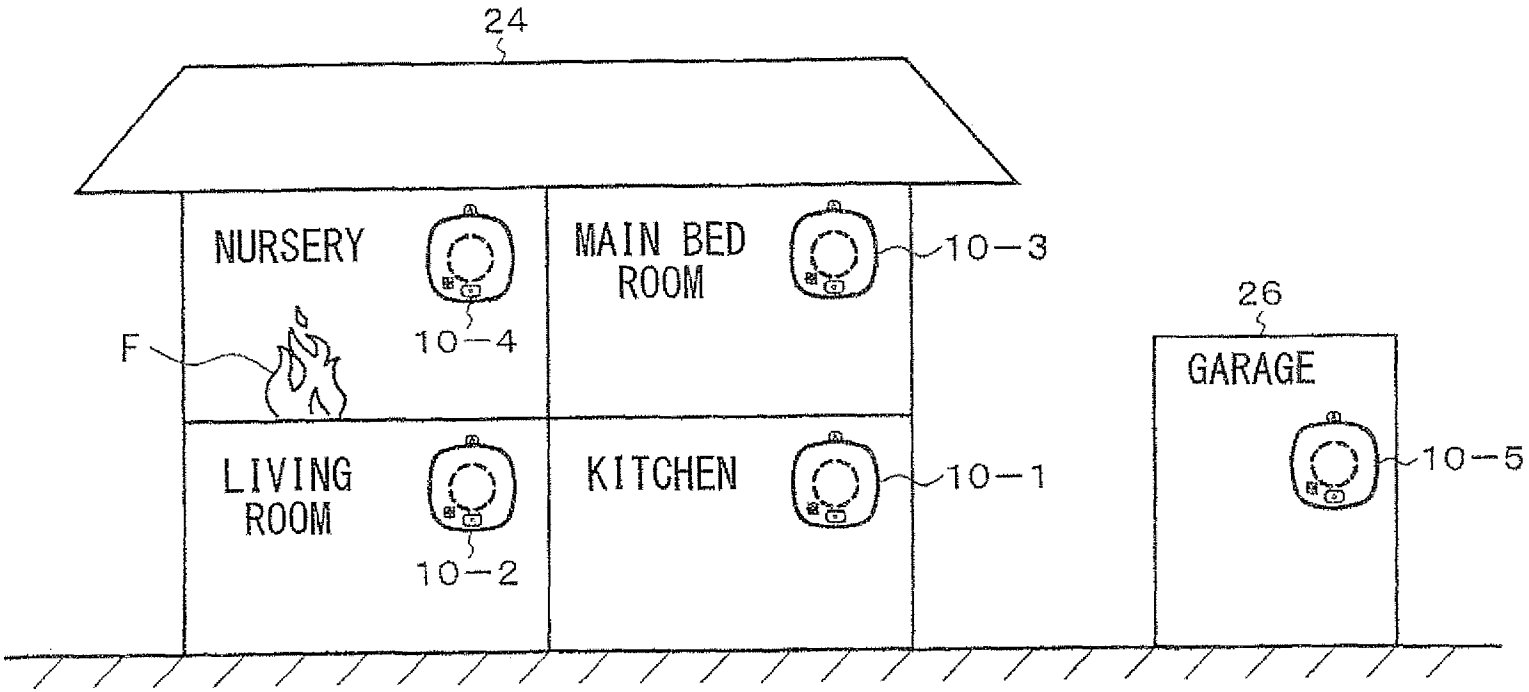
FIG. 2 is a descriptive view illustrating a condition in which the alarm is installed on a residence.

FIG. 2 is a descriptive diagram indicating the conditions in which the alarm according to the present embodiment is set up in a residence. According to the example shown in FIG. 2, an alarm 10-1 to 10-4 according to the present embodiment is respectively set up in each of the kitchen, living room, main bedroom, and the nursery of the residence 24. Furthermore, an alarm 10-5 is set up in the garage built outdoors. Incidentally, the reference F in FIG. 2 indicates a fire.

Each of the alarms 10-1 to 10-5 may transmit and receive an event signal on a reciprocal basis via radio transmission. The five alarms 10-1 to 10-5 form a coordination group, and monitors fire in the entire residence.

When a fire occurs in the nursery of the residence 24, the alarm 10-4 detects the fire and outputs a warning. The alarm "issuing an alert" refers to the alarm detecting the fire and outputting the warning. When the alarm 10-4 issues an alert, the alarm 10-4 acts as a coordination source. The other alarms 10-1 to 10-3 and 10-5 are the coordination ends. The alarm 10-4 transmits to the coordination ends, an event signal indicating a fire warning via radio transmission. After the other alarms 10-1 to 10-3 and 10-5 receives an event signal indicating a fire warning from the coordination source 10-4, the other alarms 10-1 to 10-3 and 10-5 perform a warning operation as a coordination end.

Here, as a warning sound of the alarm 10-4, the coordination source, an audio message stating, for example, "Woo, Woo, an alarm has been activated, please check," is delivered continuously. On the other hand, the alarms 10-1 to 10-3 and 10-5, the coordination end, continuously outputs an audio message stating, for example, "Woo, Woo, another alarm has been activated, please ascertain." When the warning halting switch 20, provided on the alarm 10 shown in FIGS. 1A and 1B is operated, under a condition in which the alarms 10-1 to 10-5 are letting out a warning sound, a halting procedure of the warning sound is performed.

In addition, the alarms 10-1 to 10-5 comprises a low battery monitoring unit which detects a drop in the electric voltage of the battery and issues an alert. A low battery refers to a lower limit value of an electric voltage such that the electric voltage of the battery is capable of operating properly as an alarm 10 for 72 hours, for example. When the electric voltage of the battery becomes a low battery, a warning sound such as "Pi," for instance, is outputted intermittently at a predetermined interval, and alerts that a defect has occurred. This defect warning outputted by the alarm 10 may be halted by operating the warning halting switch 20.

Furthermore, the alarm 10, which is the defect source and is in a state of low battery, may transmit an event signal to another alarm via radio transmission indicating a low battery state. The other alarm may also output the same low battery warning.

Furthermore, the alarm 10-1 to 10-5 according to the present embodiment comprises an automatic inspection feature. For example, the alarm 10-1 performs an automatic inspection of the smoke detection unit 16 provided on the sensor unit 34, transmits the inspection result to the other alarm 10-2 to 10-5 via an event signal, and as a result, each of the alarm 10-1 to 10-5 included in the group retains all of the inspection results by the alarm 10-1 to 10-5, and may report the inspection result of the group as a whole through a predetermined switch operation by an optional alarm.

Figure 3:
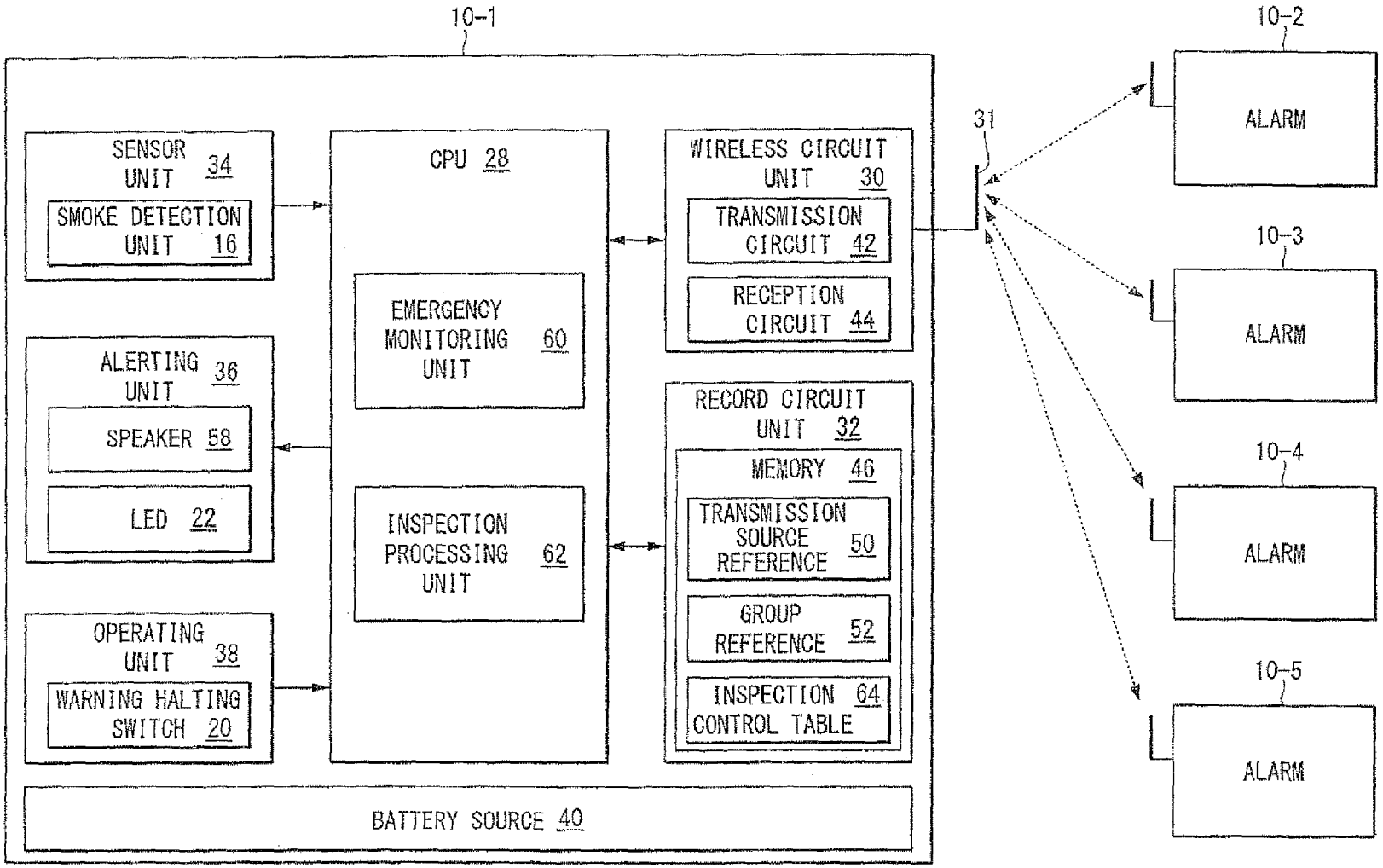
FIG. 3 is a block diagram of the alarm.

FIG. 3 is a block diagram showing an embodiment of an alarm according to the present invention. Among the five alarms 10-1 to 10-5 shown in FIG. 2, FIG. 3 shows a detailed configuration of the circuit of the alarm 10-1.

The alarm 10-1 comprises a CPU 28. With respect to the CPU 28, a wireless circuit unit 30 comprising an antenna, a record circuit unit 32, a sensor unit 34, an alerting unit 36, and an operation unit 38 are provided so as to be transmittable. Further, the alarm 10-1 comprises a battery source 40.

A transmission circuit 42 and a reception circuit 44 are provided to the wireless circuit unit 30. An event signal may be received and transmitted via radio transmission among the other alarms 10-2 to 10-5. Inside Japan, for example, the wireless circuit unit 30 comprises a configuration in accordance with STD-30 (a standard for a wireless facility of a wireless station of a low electric power security system), which is known as a standard for specified low power radio station in the 400 MHz band, or STD-T67 (a standard for specified low power radio station telemeter, a telecontrol, and a wireless facility for data transmission).

Needless to say, at places outside Japan, the wireless circuit unit 30 may be configured to be in accordance with a standard for the wireless station assigned to the region.

Here, the reception circuit 44 performs an intermittent reception operation. The intermittent reception operation of the reception circuit 44, for example, is executed as an intermittent reception with a cycle of T12 (=T1+T2), such that a reception operation time of T1=5 milliseconds, for instance, is followed by a resting time of T2=10 seconds, for instance. In correspondence to this intermittent reception, the transmission circuit 42 continuously transmits an event signal for a period of T4, which is longer than the intermittent reception cycle T12 (=T1+T2).

A memory 46 is provided to the record circuit unit 32. The memory 46 stores a transmission source reference 50, which serves as an ID (identifier) identifying the alarm, and a group reference 52 to structure a group executing a coordinated warning with a plurality of alarms as shown in FIG. 2. A 26 bit reference code, for example, is used as the transmission source 50 so that the number of alarms provided in the country is estimated and so that the same reference code does not overlap.

The group reference 52 is set as a common reference to a plurality of alarms included in a coordination group. When a group reference included in an event signal from another alarm received by the wireless circuit unit 30 matches the group reference 52 registered in the memory 46 this event signal is received as a valid signal, and is processed.

According to the present embodiment, a smoke detection unit 16 is provided on the sensor 34. A smoke detection signal according to the smoke density is outputted to the CPU 28. The smoke detection unit 16 receives light through a light receiving element, the light being emitted by the luminous element through an intermittent emission drive. The smoke detection unit 16 converts the light to a light reception signal, and outputs it. When smoke flows into this smoke detection unit 16, the light disperses due to the smoke. As a result, the dispersed light reaches the light receiving element. As a result, the smoke detection unit 16 outputs a light reception signal according to the smoke density.

Incidentally, other than the smoke detection unit 16, the sensor unit 34 may include a thermistor which detects a temperature due to fire. Further, in the case of an alarm designed to monitor a gas leak, a gas leak sensor is provided to the sensor unit 34.

The alerting unit 36 includes a speaker 58 and an LED 22. The speaker 58 outputs an audio message and a warning sound from an audio synthesizing circuit unit, which is not diagrammed. The LED 22 displays an abnormality and interference such as a fire by blinking a light on and off, flickering a light, or putting on a light.

A warning halting switch 20 is provided on the operation unit 38. When the warning halting switch 20 is operated, the warning sound being issued by the alarm 10-1 may be halted. According to the present embodiment, the warning halting switch 20 acts as an inspection switch as well. When the warning halting switch 20 is operated while the warning sound is not issued, an alerting sound indicating the inspection result is outputted.

The warning halting switch 20 becomes effective when a warning sound is being outputted by the alerting unit 36 through the speaker 58. On the other hand, in a normal monitoring condition in which a warning sound is not being outputted, the warning halting switch 20 acts as an inspection switch. When the inspection switch is pressed, an audio message and the like for inspection is outputted from the alerting unit 36.

The battery source 40 uses, for example, an alkaline battery with a predetermined number of cells. Regarding the capacity of the battery, a battery life of approximately 10 years is assured due to a low power consumption of the entire circuit unit including the wireless circuit unit 30 of the alarm 10-1.

An emergency monitoring unit 60 and an inspection processing unit 62 are provided to the CPU 28 as a feature to be realized by the execution of the program.

When an emergency monitoring unit 60 detects a fire (smoke) through the smoke detection signal by the smoke detection unit 16 provided on the sensor unit 34 exceeding a fire level, a warning sound from the speaker 58 of the alerting unit 36 indicating a coordination source is repeatedly outputted. An example of the warning sound is "Woo, Woo, an alarm has been activated, please check." At the same time, an event signal indicating the reporting of the fire is transmitted by the transmission circuit 42 of the wireless circuit unit 30 from the antenna 31 to the other alarms 10-2 to 10-5.

Furthermore, when the reception circuit 44 of the wireless circuit unit 30 receives an event signal indicating a fire alert from either one of the other alarms 10-2 to 10-5, the emergency monitoring unit 60 continuously outputs a warning sound indicating the coordination end from the speaker 58 of the alerting unit 36. An example of the warning sound is an audio message stating, "Woo, Woo, an alarm has been activated, please check."

Here, when the emergency monitoring unit 60 detects the fire alert and issues a coordination source warning sound, the LED 22 of the alerting unit 36 is flickered, for example. Meanwhile, when the coordination end warning sound is issued, the LED 22 of the alerting unit 36 is flashed. As a result, the display by the LED 22 of the coordination source warning and the coordination end warning can be discerned. Needless to say, for both the coordination source warning and the coordination end warning, the same flickering or a flashing display of the LED 22 may be used.

In addition, when the emergency monitoring unit 60 detects a low battery condition by the drop in electric voltage of the battery source 40, the emergency monitoring unit 60 outputs a defect warning sound by emitting a short low battery warning sound such as "Pi" at a rate of once per minute, for example.

The inspection processing unit 62 registers a detection result of the smoke detection unit 16 provided on the sensor unit 34 to the inspection control table 64 placed on the memory 46. At the same time, the inspection processing unit 62 transmits an event signal indicating an inspection result to the other alarms 10-2 to 10-5. When an event signal indicating an inspection result from the other alarms 10-2 to 10-5 is received, the inspection processing unit 62 registers the received inspection result to the inspection control table 64. Furthermore, when the operation input of the warning halting switch 20 is discerned while there is not warning output, the inspection control table 64 is referred to, and the inspection result of a plurality of alarms 10-1 to 10-5, which are in coordination including oneself, is reported.

The inspection of the smoke detection unit 16 by the inspection processing unit 62 is performed, for example, at a cycle of 10 seconds. A first light reception level V1 of the light receiving element when the light emitting element driven to illuminate intermittently is illuminated is detected. Further, a second light reception level V2 of the light receiving element when the light emitting element is prevented from illuminating is detected. Further, a difference between the two levels $\Delta V$ (=V1−V2) is determined. When the level difference $\Delta V$ is less than a predetermined threshold, the detection result is set to be abnormal. When the level difference $\Delta V$ is greater than or equal to a predetermined threshold, the detection result is set to be normal. Thus, a registration is made to the inspection control table 64. At the same time, an event signal indicating the inspection result is transmitted to the other alarms 10-2 to 10-5.

Incidentally, when a temperature detection element such as a thermistor is provided on the sensor unit 34, and thus a temperature detection unit is provided, which detects a temperature due to fire, the inspection processing unit 62 sets the inspection result to abnormal when a short circuit (short), such that a resistance value of the temperature detection element becomes approximately zero, or a severance (open), such that a resistance value of the temperature detection element becomes approximately infinitely large, are detected. In other instances, the inspection processing unit 62 sets the inspection result to normal.

FIG. 4 is a descriptive diagram of the inspection control table 64 provided on the memory 46 of FIG. 3. The inspection control table 64 of FIG. 4 registers the alarm ID and the inspection result. Regarding the alarm ID, for each of the alarms 10-1 to 10-5 comprising the group, "01" to "05" are respectively registered. In correspondence to these alarm IDs, an inspection result is registered, indicating either "normal" or "abnormal." In actuality, a flag bit, for example, is registered as an inspection result. In a normal condition, 0 bit is registered, while 1 bit is registered for an abnormal condition.

The inspection control table 64 has an initial registration of "normal (0)" as an inspection result for all of the alarms 10-1 to 10-5 included in the group. Thus, when the inspection result is abnormal, the inspection processing unit 62 in FIG. 3 transmits an event signal showing an abnormality to the other alarms 10-2 to 10-5. When the inspection result is normal, and an event signal indicating an abnormality has been transmitted last time, the inspection processing unit 62 transmits an event signal indicating a normal condition.

Further, when the inspection processing unit 62 discerns an operation input of the warning halting switch 20 when a warning output has not been made, the inspection processing unit 62 outputs from the speaker 58, an alerting sound stating "an emergency has occurred" indicating that an abnormality has occurred when the inspection result of at least one alarm registered with the inspection control table 64 is "abnormal (1)." When the inspection result of all of the alarms is "normal (0)," the inspection processing unit 62 outputs from the speaker 58, an alerting sound stating "there is no emergency," for example, to indicate a normal condition.

An analysis of whether or not an inspection abnormality is registered in the inspection control table 64 is made by taking a logical sum of the detection result of the alarms 10-1 to 10-5. When the logical sum is 0 bit, it is determined that the condition is normal. When the logical sum is 1 bit, it is determined that the condition is abnormal.

Furthermore, when the inspection processing unit 62 discerns an operation input of the warning halting switch 20 when there is not warning output, the inspection processing unit 62 transmits an event signal indicating an abnormality to the alarm at the source of the abnormality that occurred, when the detection result of the alarm registered at the inspection control table 64 is abnormal. Meanwhile, when the inspection processing unit 62 receives an event signal from another alarm indicating an abnormality, the inspection processing unit 62 outputs an alerting sound indicating that an abnormality has occurred.

Figure 5:
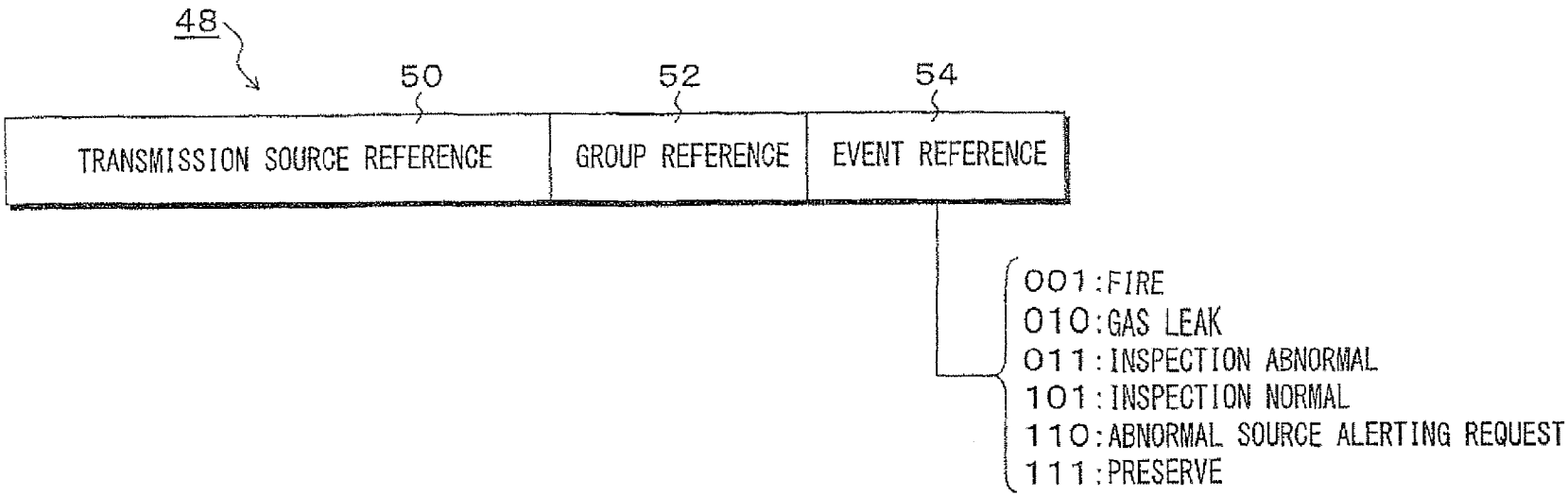
FIG. 5 is a descriptive view illustrating a format of an event signal used in the aspect of the present invention.

FIG. 5 is a descriptive diagram showing a format of the event signal used in the present embodiment. In FIG. 5, the event signal 48 includes a transmission source reference 50, a group reference 52, and an event reference 54. An example of a transmission source reference 50 is a 26 bit reference. Further, an example of the group reference 52 is an 8 bit reference. The same group reference is set for the five alarms 10-1 to 10-5 in FIG. 3, for example, forming the same group.

Incidentally, as the group reference 52, other than setting a same group reference 52 to the alarms included in a same group, it is also possible to set a group reference which is different for each alarm determined by a computation between an inherent transmission source reference of each alarm and a standard reference common to the alarms included in a predetermined group.

The event reference 54 is a reference representing event contents such as an abnormality such as fire and gas leak. According to the present embodiment, a 3 bit reference is used. For example, "001" indicates a fire, "010" indicates a gas leak, "011" indicates an inspection emergency, "101" indicates a normal inspection condition, "110" indicates an alert request of the source of abnormality, and the rest is reserved.

Incidentally, when the type of events increases, the bit number of the event reference 54 may represent event contents of a plurality of types by increasing the bit by 4 bits, 5 bits, and the like.

Figure 6:
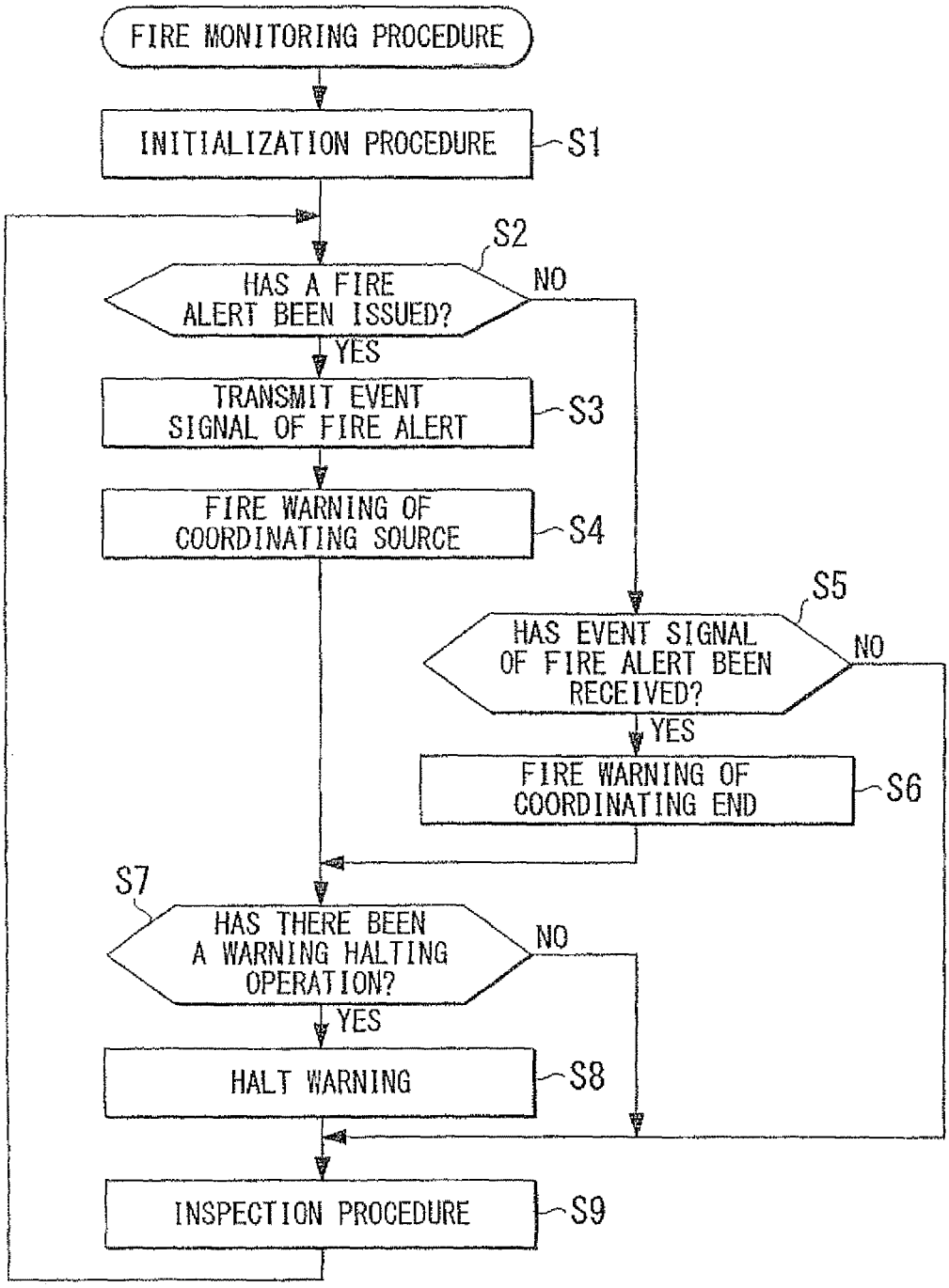
FIG. 6 is a flowchart showing a fire monitoring procedure by a CPU based on FIG. 3 according to the aspect of the present invention.

FIG. 6 is a flowchart representing a fire monitoring process by the CPU 28 provided on the alarm 10-1 of FIG. 3. In FIG. 6, when the battery source 40 of the alarm 10-1 is turned on (on), an initialization process is performed in step S1. This initialization process includes a setting of the group reference 52 to form a group of coordinated warnings among the other alarms 10-2 to 10-5.

Next, the alarm 10-1 enters a state of monitoring, and in step S2, whether or not a fire warning has been activated is determined according to whether or not a smoke detection signal from the smoke detection unit 16 provided on the sensor unit 34 exceeds a predetermined fire level. When it is determined in step S2 that a fire warning has been activated, the procedure moves on to step S3, and transmits an event signal 48 of the activation of the fire warning to the other alarms 10-2 to 10-5. Thereafter, a fire warning of the coordination source is outputted in step S4. In particular, a warning sound is outputted from the speaker 58 of the alerting unit 36. At the same time, the LED 22 is turned on.

After an activation of the fire warning of the coordination source has been made, whether or not there is a warning halting operation by the warning halting switch 20 is determined in step S7. When there is a warning halting operation, the warning is halted in step S8.

Meanwhile, when an activation of the fire warning is not discerned in step S2, whether or not an event signal 48 from the other alarms 10-2 to 10-5 has been received is checked in step S5. When an event signal of a fire warning activation is received, a fire warning of the coordination end is outputted in step S6. Thereafter, when there is a warning halting operation in step S7, the warning is halted in step S8. Thereafter, an inspection process is carried out by the inspection processing unit 62 in step S9.

Figure 7:
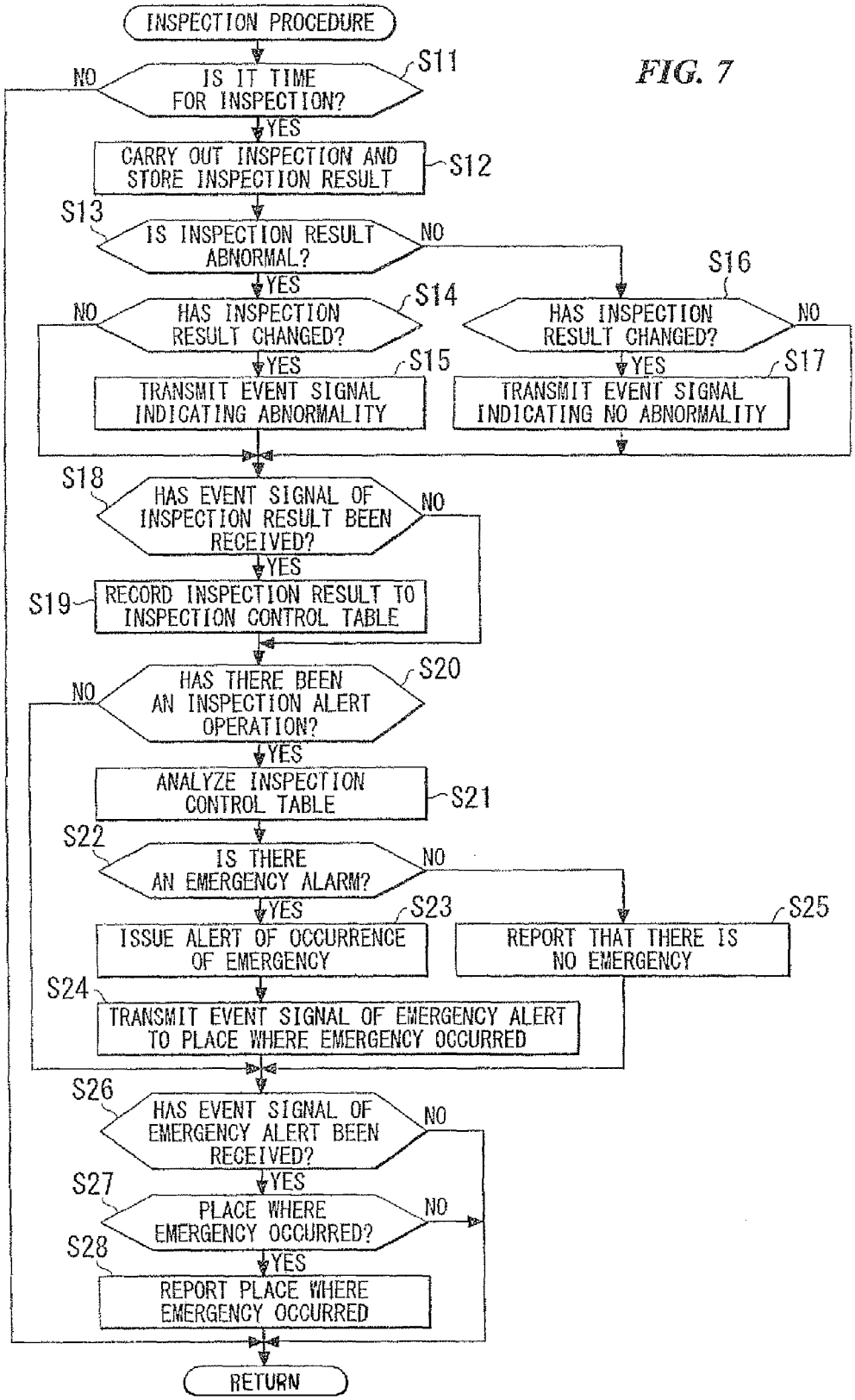
FIG. 7 is a flowchart showing a subroutine of a checking procedure in step S9 of FIG. 6.

FIG. 7 is a flowchart showing a subroutine of the inspection process in step 9 of FIG. 6. According to FIG. 7, the inspection process determines in step S11 whether or not it is time to perform an inspection based on a predetermined cycle. When it is determined that it is time for an inspection, the procedure moves on to step S12. In step S12, an inspection of the smoke detection unit 16, provided on the sensor unit 34, is made. It is determined whether the detection result is "normal" or "abnormal," and is stored in the field of detection result corresponding to one's alarm ID in the inspection control table 64 shown in FIG. 4.

The inspection of the smoke detection unit 16 is performed at a cycle of 10 seconds, for example. A first light reception level V1 of the light receiving element when the light emitting element driven to illuminate intermittently is illuminated is detected. Further, a second light reception level V2 of the light receiving element when the light emitting element is prevented from illuminating is detected. Further, a difference between the two levels $\Delta V$ (=V1−V2) is determined. When the level difference $\Delta V$ is less than a predetermined threshold, the detection result is set to be abnormal. When the level difference $\Delta V$ is greater than or equal to a predetermined threshold, the detection result is set to be normal.

Next, when it is discerned that the inspection result in step S13 is "abnormal," the procedure moves on to step S14. In step S14, when it is discerned that the inspection result has changed from "normal" to "abnormal," the procedure moves on to step S15. In step S15, an event signal 48, indicating that the inspection result is "abnormal," is transmitted to the other alarms 10-2 to 10-5. Here, the event signal 48 is obtained by setting the event reference 54 in FIG. 5 is set to "011."

Meanwhile, when the inspection result is "normal," the procedure moves on to step S16. When it is discerned that the inspection result has changed from "abnormal" to "normal," the procedure moves on to step S17. In step S17, an event signal 48, indicating that the inspection result is "normal," is transmitted to the other alarms 10-2 to 10-5. Here, the event signal 48 is obtained by setting the event reference 54 in FIG. 5 to "101."

Here, the event signal 48 indicating the detection result is transmitted in steps S15 and S17 only when the detection result has changed in steps S14 and S16. Therefore, when either the detection result "normal" or "abnormal" is maintained, an event signal 48 showing the detection result is not transmitted. Thus, electric current is prevented from being consumed by a transmitting operation. Thus, the lifetime of the battery source 40 is prolonged.

Next, in step S18, it is determined whether or not there has been a reception of the event signal 48 indicating an inspection result from the other alarms 10-2 to 10-5. When the event signal 48 has been received, the procedure moves on to step S19. In step S19, an information showing "abnormal" or "normal," which is the received inspection result, is stored and overwritten in the inspection result field of the alarm ID corresponding to the transmission source reference 50 in the inspection control table 64 in FIG. 4.

Next, when an inspection alerting operation by a warning halting switch 20 is discerned, under a condition in which an output of a warning has not been made, the procedure moves on to step S21. In step S21, the inspection control table 64 in FIG. 4 is analyzed, and it is determined whether or not there is an alarm in the group such that the inspection result is "abnormal."

In particular, a logical sum of the flag bit of the inspection control table 64 is determined. When the logical sum is 0 bit, it is determined that there is no alarm in the group such that the inspection result is "abnormal." When the logical sum is 1 bit, it is determined that there is an alarm in the group such that the inspection result is "abnormal."

Next, when it is discerned in step S22 that there is an alarm in the group such that the inspection result is "abnormal," the routine moves on to step S23. The speaker 58 outputs an audio message such as "an emergency has occurred," indicating that an abnormality has occurred. Further, in step S24, an event signal 48 alerting an emergency is transmitted to the alarm at the source where the emergency occurred. Here, the event signal 48 is obtained by setting the event reference 54 in FIG. 5 to "110." Incidentally, in step S22, when the inspection result is "normal," the procedure moves on to step S25, and issues an alert by outputting an audio message from the speaker 58 stating, for example, "the condition is normal."

Next, when an event signal 48 is received in step S26 from another alarm alerting an abnormality, the procedure moves on to step S27. In step S27, in the case of an alarm at a source of abnormality, the procedure moves on to step S28, and an audio message such as "an emergency has occurred" is outputted by the speaker 58. At the same time, the LED 22 is turned on and off, indicating a source of abnormality. According to this alerting of the source at which the abnormality has occurred, the user is able to ascertain the alarm within the group at which the abnormality has occurred. Therefore, it is preferable that the alerting of the source at which the abnormality has occurred is outputted repeatedly for 10 minutes, for instance, at an interval of one minute, for instance.

Incidentally, according to the embodiment described above, an alarm 10 detecting a fire was given as an example. Other than this example, it is possible to directly apply, as appropriate, a monitoring procedure according to the present embodiment, including a preliminary abnormality, to a gas leak alarm, a crime-prevention alarm, and other alarms detecting an abnormality. Further, other than a use for residential purposes, the present invention may be applied to alarms for various types of uses including building and office use.

Further, according to the above embodiment, an example was provided such that a sensor unit is integrated with the alarm. However, as a different embodiment, a configuration of the alarm is possible such that a sensor unit is provided separately from the alarm.

While a preferred embodiment of the present invention has been described above, it should be understood that these are exemplary of the invention and are not to be considered as limiting the present invention. Additions, omissions, substitutions, and other modifications can be made without departing from the scope of the present invention. The invention is not to be considered as being limited by the foregoing description, is neither limited by the numbers provided in the foregoing description, and is only limited by the scope of the appended claims.

INDUSTRIAL APPLICABILITY

An alarm according to the present invention may be applied effectively to an alarm which detects an abnormality such as a fire and issues a warning. At the same time, an alarm according to the present invention may be applied effectively to an alarm which transmits a signal to another alarm via radio transmission and outputs a warning in coordination.

The invention claimed is:

1. An alarm comprising:

a transmission reception circuit unit transmitting and receiving an event signal with an other alarm;

a sensor unit detecting an abnormality;

an alerting unit outputting an abnormality warning;

an abnormality monitoring unit receiving an abnormality detection signal from the sensor unit, while outputting the abnormality warning of a coordination source, and transmitting to the other alarm the event signal indicating an abnormality, meanwhile, outputting the abnormality warning of a coordination end when the event signal indicating an abnormality is received from the other alarm; and an inspection processing unit transmitting to the other alarm an event signal indicating a self inspection result, and, when an event signal indicating an inspection result is received from the other alarm, reporting an inspection result of a plurality of alarms in coordinated relation.

2. An alarm comprising:

a transmission reception circuit unit transmitting and receiving an event signal with an other alarm;

a sensor unit detecting an abnormality;

an alerting unit outputting an abnormality warning;

an abnormality monitoring unit receiving an abnormality detection signal from the sensor unit, while outputting the abnormality warning of a coordination source, and transmitting to the other alarm the event signal indicating an abnormality, meanwhile, outputting the abnormality warning of a coordination end when the event signal indicating an abnormality is received from the other alarm; and an inspection processing unit registering an inspection result of a self to a control table, and, transmitting to the other alarm an event signal indicating the inspection result, when an event signal indicating an inspection result is received from the other alarm registering the inspection result received into the control table, and, when a predetermined operation input is discerned, reporting an inspection result of a plurality of alarms in coordinated relation based on the control table.

3. The alarm according to either one of claim 1 or claim 2, wherein the inspection processing unit transmits to the other alarm an event signal indicating an abnormality when the inspection result changes from normal to abnormal, and transmits to the other alarm an event signal indicating a normal condition when the inspection result changes from abnormal to normal.

4. The alarm according to claim 2, wherein when the inspection processing unit receives an event signal indicating an abnormality, the inspection processing unit rewrites an inspection result of a corresponding alarm to abnormal in the control table, meanwhile, when the inspection processing unit receives an event signal indicating a normal condition, the inspection processing unit rewrites an inspection result of a corresponding alarm to normal in the control table.

5. The alarm according to claim 2, wherein when the inspection processing unit discerns a predetermined operation input, the inspection processing unit outputs an alerting sound indicating an occurrence of an abnormality when an inspection result of at least one alarm registered to the control table is abnormal, and outputs an alerting sound indicating a normal condition when an inspection result of all alarms is normal.

6. The alarm according to claim 2, wherein when the inspection processing unit discerns a predetermined operation input, the inspection processing unit transmits to an alarm at an abnormality occurrence source an event signal indicating an abnormality alert when an inspection result of an alarm registered with the control table is abnormal, meanwhile, the inspection processing unit outputs an alerting sound indicating an occurrence of an abnormality when the inspection processing unit receives an event signal from the other alarm indicating an abnormality alert.

7. The alarm according to claim 1 or 2, wherein the sensor unit comprises a light emitting element and a light receiving element, and is a smoke detection unit converting a light received at the light receiving element to a light reception signal; and the inspection processing unit detects a first light reception level of the light receiving element when the light emitting element is illuminated, and also detects a second light reception level of the light receiving element when the light emitting element is not illuminated, and determines a difference between the first light reception level and the second light reception level, and when the difference is less than a predetermined threshold, the inspection result is set to abnormal, meanwhile, when the difference is greater than or equal to the predetermined threshold, the inspection result is set to normal.

8. The alarm according to claim 1 or 2, wherein the sensor is a temperature detection unit comprising a temperature detection element; and the inspection processing unit sets an inspection result to abnormal when the inspection processing unit detects a short, in which a resistance value of the temperature detection element becomes approximately zero, or when the inspection processing unit detects a severance, in which a resistance value of the temperature detection element becomes approximately infinitely large, and in an other instance, the inspection processing unit sets the inspection result to normal.

* * * * *